US005865554A

United States Patent [19]

Lin

[11] Patent Number: 5,865,554

[45] Date of Patent: Feb. 2, 1999

[54] PORTABLE DOUBLE-BRUSH SHOE POLISHING DEVICE

[76] Inventor: Pin-Huang Lin, P.O. Box 82-144, Taipei, Taiwan

[21] Appl. No.: 897,652

[22] Filed: Jul. 21, 1997

[51] Int. Cl.[6] ..... A47L 23/05

[52] U.S. Cl. ..... 401/206; 401/37; 401/39; 401/273; 401/278; 401/279; 401/283

[58] Field of Search ..... 401/24, 37, 39, 401/206, 272, 273, 278, 279, 283

[56] References Cited

U.S. PATENT DOCUMENTS

| | | | |
|---|---|---|---|
| 738,455 | 9/1903 | King | 401/273 |
| 1,138,772 | 5/1915 | Mathews | 401/273 |
| 2,095,433 | 10/1937 | Brunauer | 401/278 |
| 2,517,152 | 8/1950 | Wilson | 401/273 X |
| 2,556,112 | 6/1951 | Schwartz | 401/37 |
| 4,493,576 | 1/1985 | Suhh | 401/24 X |
| 5,176,461 | 1/1993 | Kimura | 401/273 X |

*Primary Examiner*—Steven A. Bratlie

*Attorney, Agent, or Firm*—A & J

[57] ABSTRACT

A portable double-brush shoe polishing device includes a polish body, and an assembly comprising a press button and a polishing storage tube. The polish body is designed to facilitate holding by the human hand, and it comprises an annular outer brush at a bottom side thereof. The press button is held in the polish body in a resilient condition. The press button has a positioning rib and a curved flange formed thereon to achieve positioning. An inner brush is disposed beneath the press button and the polish oil storage tube. In use, the outer brush is used to preliminarily clean and wipe the shoe surface, and the press button is pressed to allow penetration of a suitable amount of polish oil into the inner brush which may then polish the shoe surface with an even distribution of the polish oil. If another amount of polish oil is required, a little pressure is applied to the inner brush so that it retracts inwardly slightly, causing the valve cover to open to allow polish oil in the press button to penetrate the inner brush again. Thus, the user may easily control the flow of polish oil in polishing shoes. Besides, the outer brush may be covered by a protective cover after use.

1 Claim, 8 Drawing Sheets

PORTABLE DOUBLE-BRUSH SHOE POLISHING DEVICE

BACKGROUND OF THE INVENTION

1. Field of the Invention

This invention relates generally to a shoe polishing device, and more particularly to a portable double-brush shoe polishing device which is compact in structure and may be used to quickly polish shoes.

2. Description of the Prior Art

The conventional way of cleaning or polishing shoes is to use a cloth to rub some shoe polish oil onto the shoe surface. This method not only would dirty the hands but also requires a long time to make the shoes shine. For white-collars who need to rush to work early in the morning, such slow way of polishing shoes is inefficient.

SUMMARY OF THE INVENTION

This invention relates generally to a shoe polishing device, and more particularly to a portable double-brush shoe polishing device which is compact in structure and may be used to quickly polish shoes.

Accordingly, a primary object of the present invention is to provide a portable double-brush shoe polishing device which may be used to polish shoes in a quick and convenient fashion.

Another object of the present invention is to provide a portable double-brush shoe polishing device in which the flow of polish oil may be controlled so that the polish oil may be used economically.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
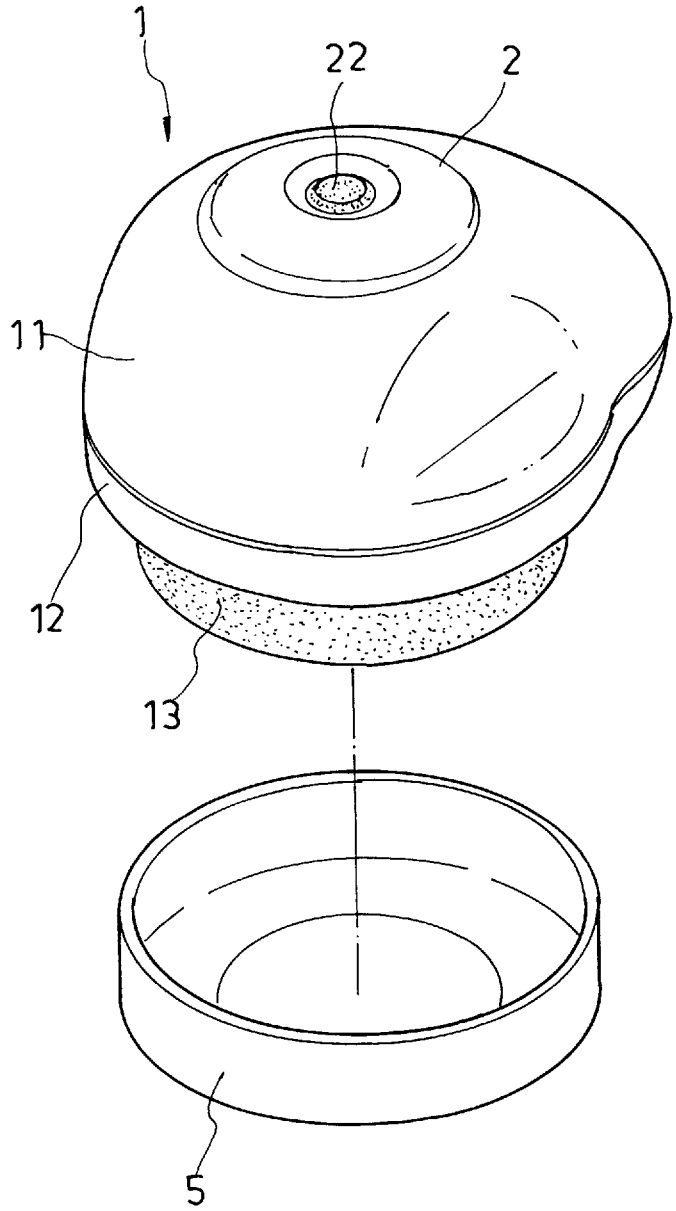
FIG. 1 is a schematic elevational view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to FIG. 1, the present invention essentially comprises a polishing body 1 having an upper cover 11 and a lower cover 12. The overall appearance and shape of the polishing body 1 is in accord with ergonomics so that it is comfortable and convenient to hold in the hand. The polishing body 1 accommodates a press button 2 which projects slightly from the polishing body 1 for pressing by the user so as to control the rubbing action of an inner brush 31 and an outer brush 13. And after use, the outer brush 13 may be covered by a protective cover 5.

Figure 2:
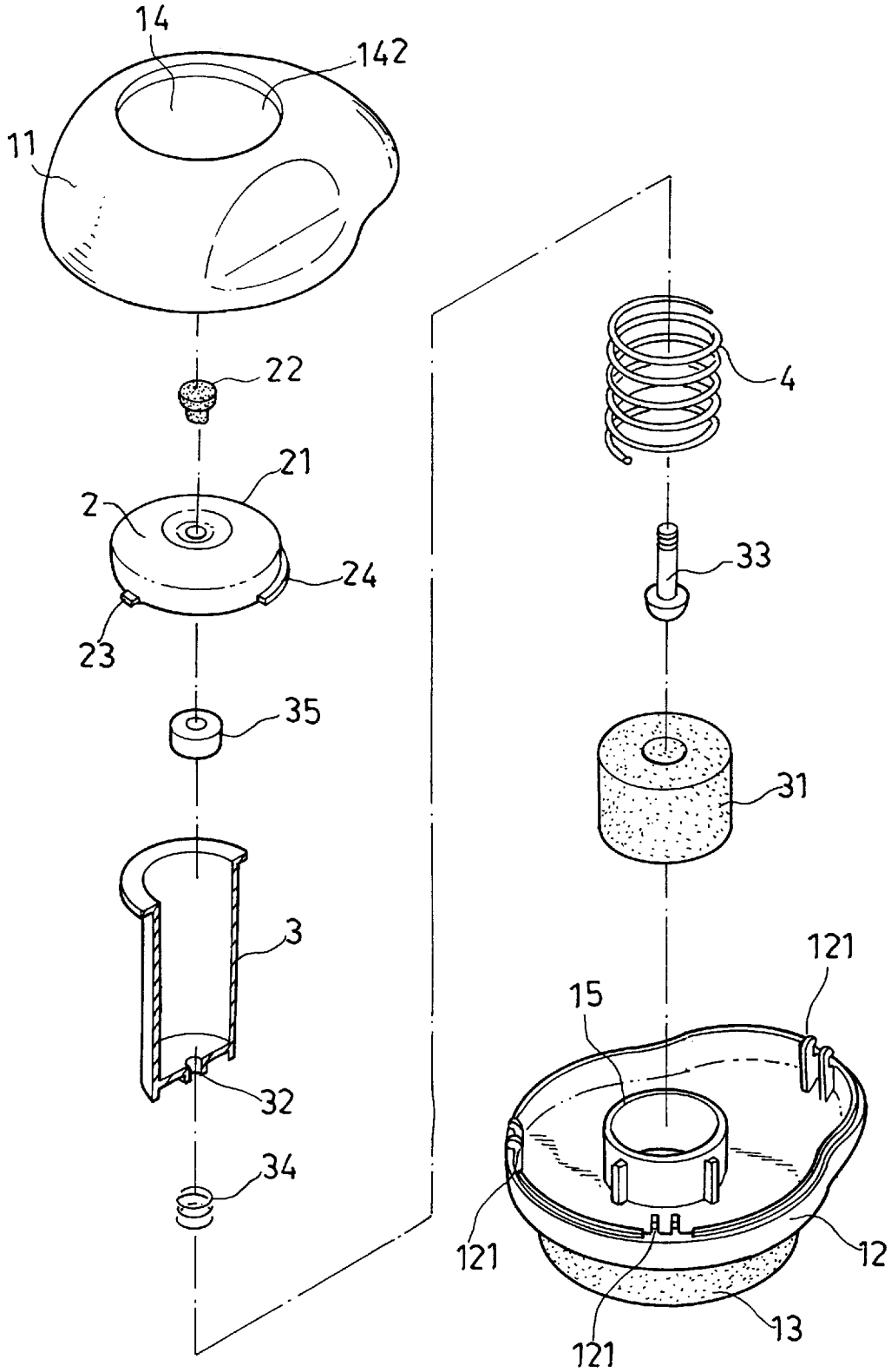
FIG. 2 is schematic elevational exploded view of the present invention.
Figure 3:
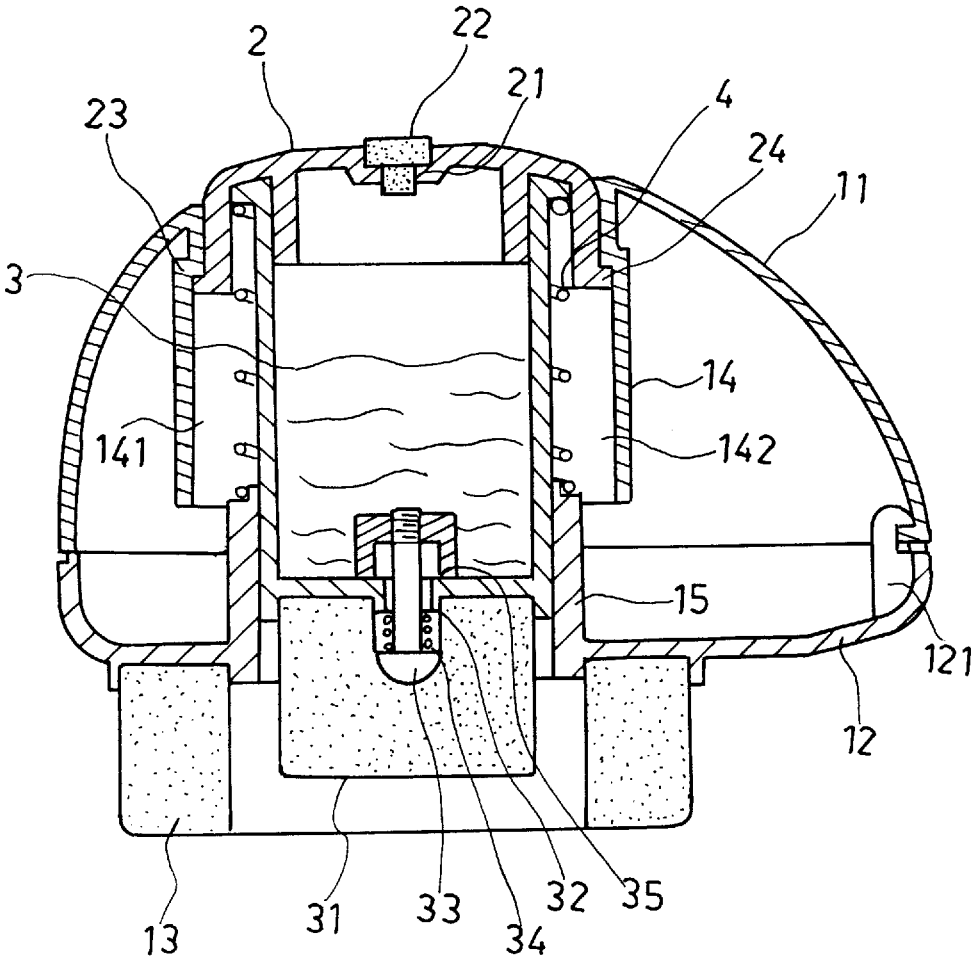
FIG. 3 is a schematic sectional view of the present invention.

Referring to both FIG. 2 and FIG. 3, the upper cover 11 and the lower cover 12 are substantially assembled by means of a plurality of hooks 121 provided at a periphery of the lower cover 12. The outer brush 13 is annular in shape and is adhered to a bottom side of the lower cover 12. The outer brush 13 may be formed by bristles or sponge material.

The upper cover 11 and the lower cover 12 are respectively provided with circular tubular guide seats 14, 15 so that they together define a cylindrical channel after assembly for accommodating therein a polish oil storage tube 3. A lower end of the polish oil storage tube 3 is connected to the inner brush 31, while an upper end thereof is connected to the press button 2. The press button 2 is provided with a filler hole 21 at an upper end thereof so that a suitable amount of shoe polish oil may be poured via the filler hole 21. A cap 22 of a soft material may be used to seal the filler hole 21. The polish oil storage tube 3 is enclosed with a reset spring 4 thereon. The reset spring 4 has an upper end and a lower end respectively urging against the polish oil storage tube 3 and the guide seat 15, so that the polish oil storage tube 3 is in a resilient state. In a normal state, an upper end of the the press button 2 projects upwardly out of the polish body 1. The inner wall of the guide seat 14 is formed with a front slide groove 141 and a rear slide groove 142 that face each other. The press button 2 further has a positioning rib 23 at a front side thereof and a curved flange 24 at a rear side thereof. The positioning rib 23 and the curved flange 24 may slide along the front and rear slide grooves 141 and 142 respectively. Also, the press button 2 may be retained thereby so that it may not slip out of the polish body 1. An oil port 32 is provided at the bottom of the polish oil storage tube 3 to allow penetration of the shoe polish oil from the polish oil storage tube 3 onto the inner brush 31. It should be emphasized that the oil port 32 has a rod 33 passing therethrough. One end of the rod 33 extends into the inner brush 31 and is fitted with a resilient element 34; the other end of the polish oil storage tube 3 extends into the polish oil storage tube 3 and is coupled to a circular valve cover 35. The rod 33 is in a resilient state. Under normal conditions, the rod 33 is subject to the resilient action of the resilient element 34 so that the valve cover 35 tightly attaches to a bottom plate of the polish oil storage tube 3 to seal the oil port 32, preventing the polish oil in the polish oil storage tube 3 from penetrating into the inner brush 31. If a force is applied to the rod 33 from below, the rod 33 will retract inwardly so that the valve cover 35 no long seals the oil port 32 and allows the polish oil into the inner brush 31. In the present invention, the valve cover 35 controls the flow of polish oil from the polish oil storage tube 3.

Figures 4, 4A, 4B:
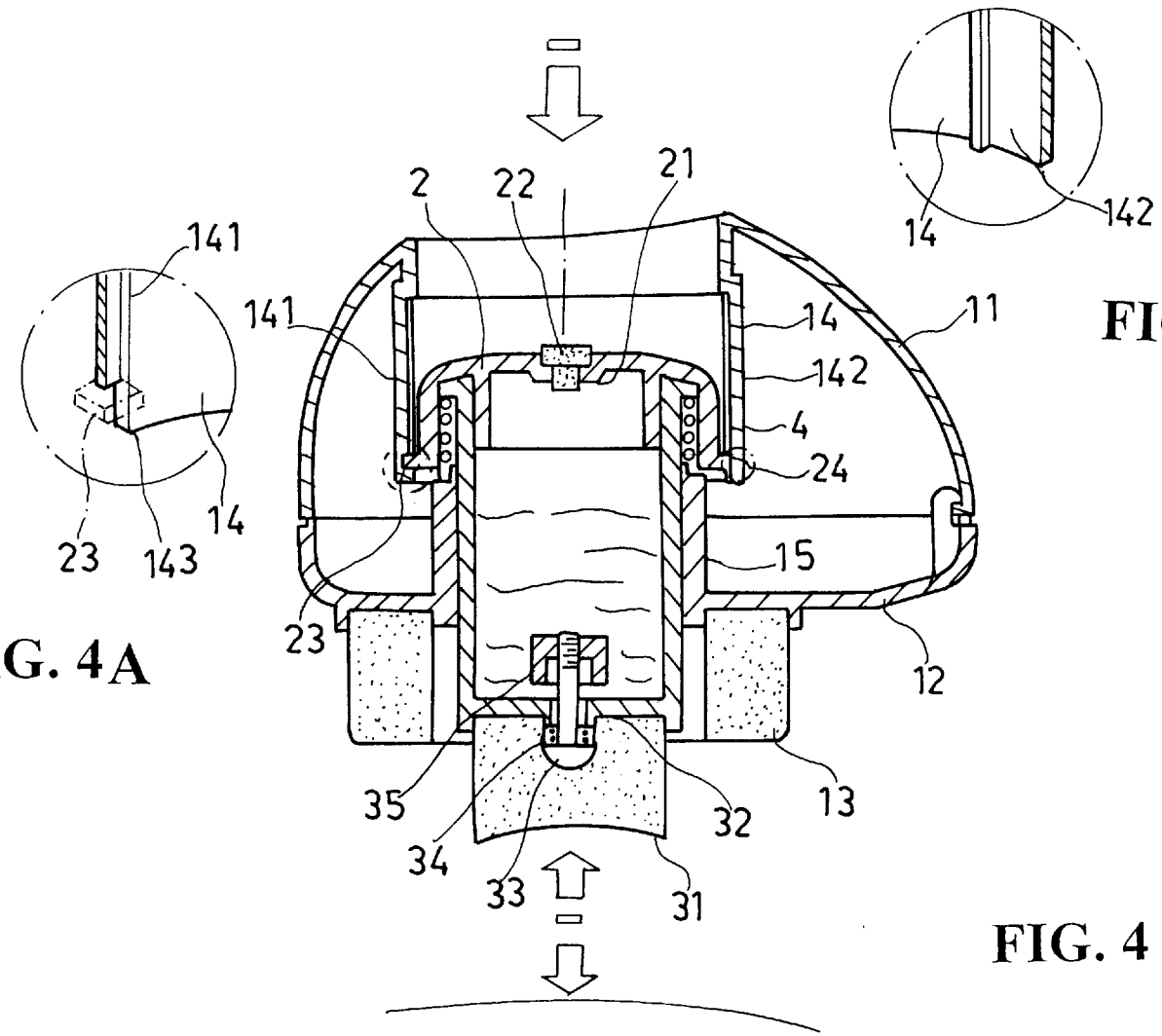
FIG. 4 is a schematic view illustrating that the press button is pressed to cause the inner brush to project from the outer brush and that the inner brush is pressed so that the valve cover opens to allow outflow of polish oil.
FIG. 4A is an enlarged fragmentary view of FIG. 4.
FIG. 4B is another enlarged fragmentary view of FIG. 4.

FIGS. 4, 4A and 4B, illustrate the positioning structure of the press button 2. When the press button 2 is pressed, the positioning rib 23 and curved flange 24 at the front and rear sides thereof will slide along the front and rear slide grooves 141, 142 of the guide seat 14. When they slide to the bottom lateral edges of the guide seat 14, as the front slide groove 141 is provided with a positioning notch 143 and there is a clearance between the press button 2 and the front slide groove 141, the press button 2 may slant to one side a little so that the positioning rib 23 may engage the positioning notch 143 as desired to achieve positioning effects. By only pressing the press button 2 once, the inner brush 31 will be caused to remain in the state wherein it projects from the outer brush 13. To release, it is only necessary to apply a little pressure at the rear side of the press button 2 so that the positioning rib 23 disengages from the positioning notch 143, and the outer brush 13 will immediately reset to its normal position due to the action of the resilient element.

Figure 5:
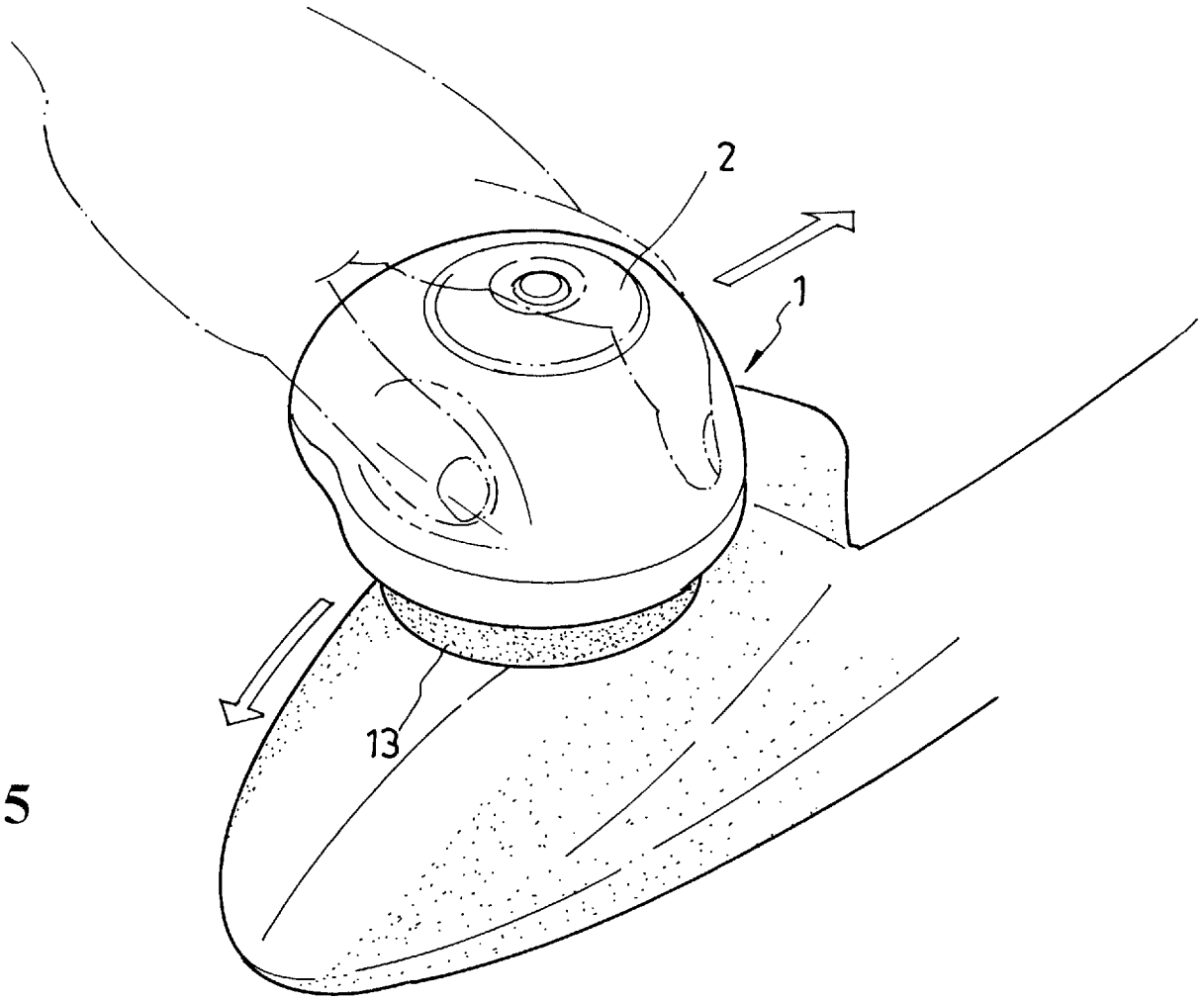
FIG. 5 is a schematic view illustrating the present invention in use.

Referring to FIGS. 3 and 5, in actual use, if the press button 2 is not pressed, the inner brush 31 cannot project from the outer brush 13 so that the user can only use the outer brush 13 to rub the surfaces of the shoes as a preliminary cleaning procedure.

Figure 6:
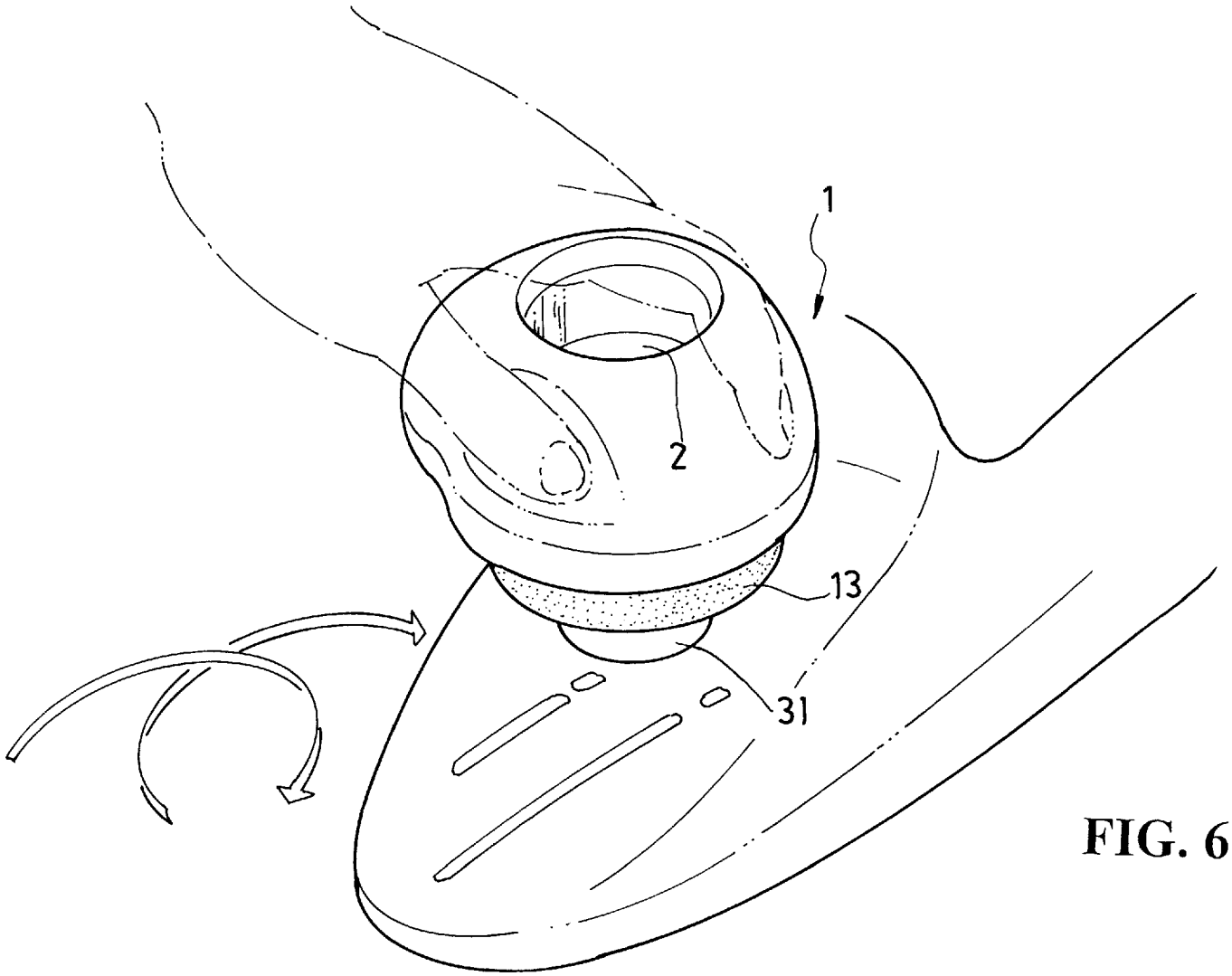
FIG. 6 is another schematic view illustrating the present invention in use.

Referring to FIGS. 4 and 6, when the press button 2 is pressed so that the outer brush 31 projects from the outer brush 13 and is positioned, by applying just a little pressure so that the inner brush 31 touches the shoe surface and sinks a little bit inwardly, the rod 33 inside the inner brush 31 will also retract slightly so that the valve cover 35 at one end of the rod 33 disengages from the position in which the oil port 32 is sealed, and the polish oil storage tube 3 will therefore flow out via the oil port 32 into the inner brush 31 for polishing the shoe surface. When the inward pressure on the inner brush 31 disappears (referring to FIG. 3), the rod 33 will reset as a result of the action of the resilient element 34, and the valve cover will close the oil port 32 so that the polish oil cannot penetrate into the inner brush 31 any more. If the user finds it necessary to have more oil to polish the shoe surface with the inner brush 31, he/she may just apply a little pressure on the press button 2 so that the inner brush 31 retracts slightly inwardly, thus controlling the flow of polish oil. In this way, the polish oil can be used economically and can be controlled to distribute evenly in the inner brush.

Figure 7:
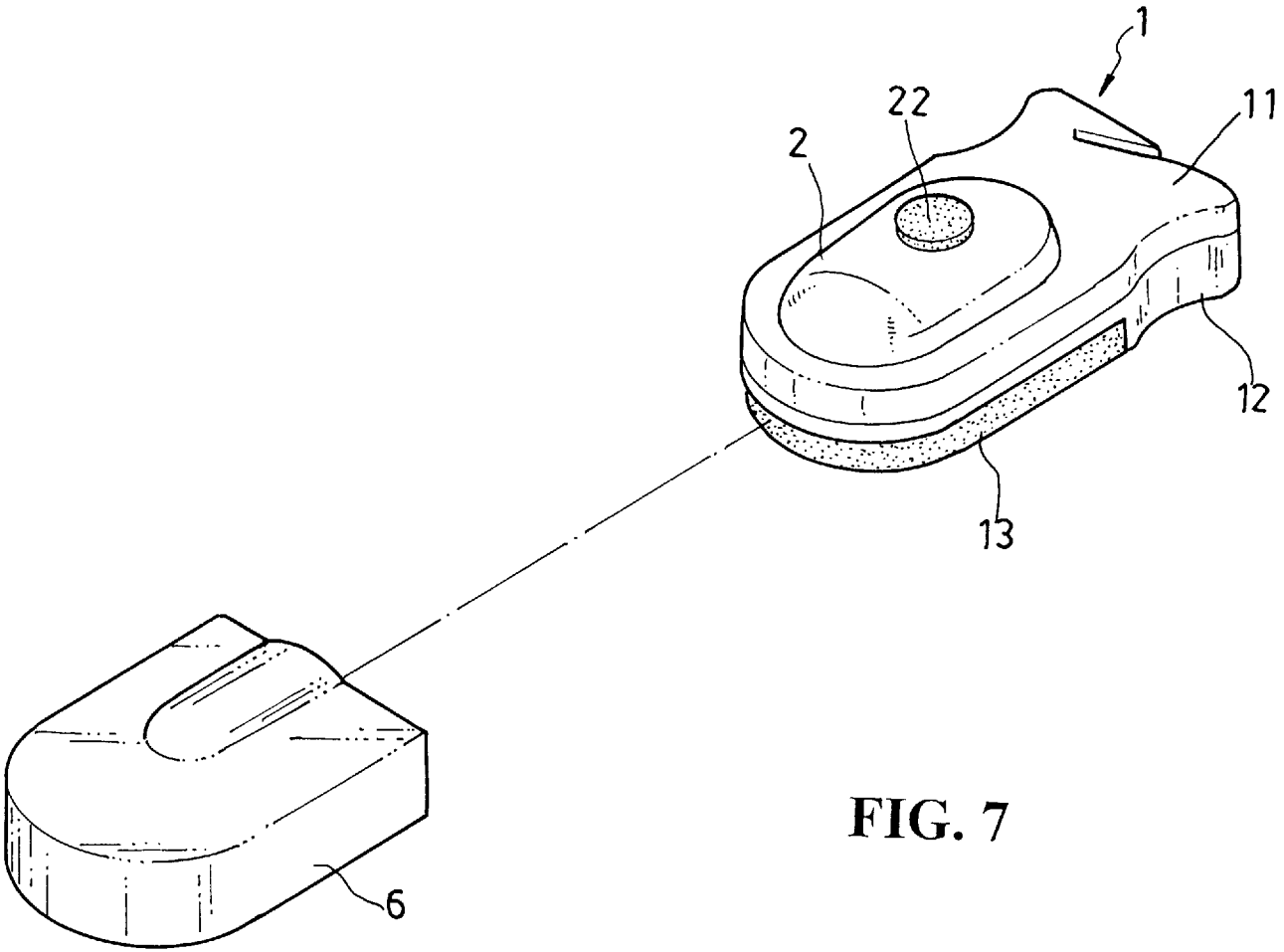
FIG. 7 is a schematic view of another preferred embodiment of the present invention.

With reference to FIG. 7, the present invention may be made in a compact shape so that it may have a small overall thickness in appearance. Besides, it may be kept in a storage box 6 for carrying around with the user.

Figure 8:
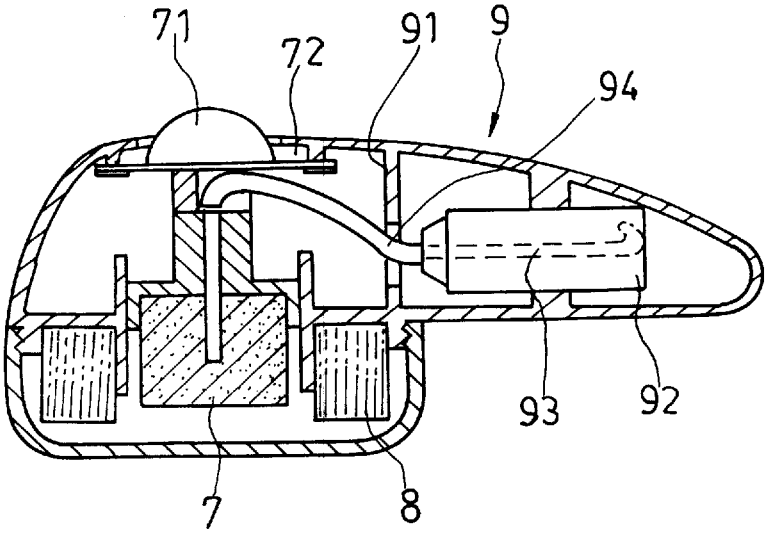
FIGS. 8 and 9 illustrate still another preferred embodiment of the present invention.
Figure 9:
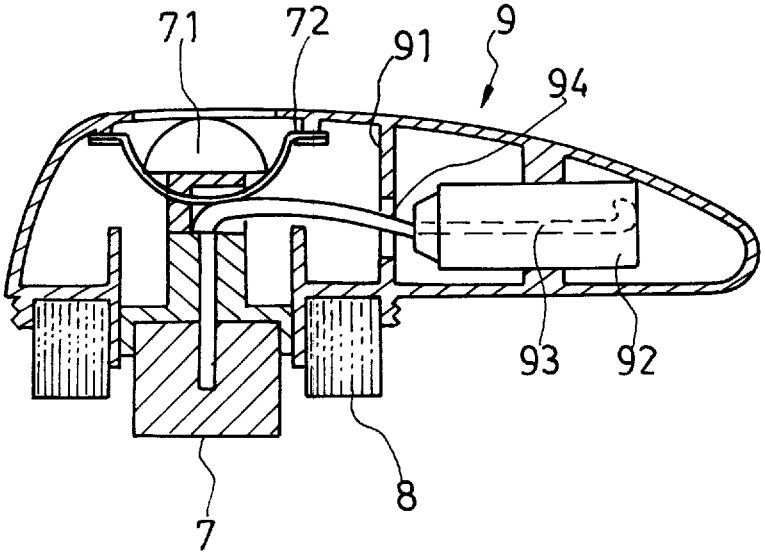

Referring to FIGS. 8 and 9, which show another preferred embodiment of the present invention, this embodiment comprises an outer brush 7 and an inner brush 8 which are identical to the structures of the inner brush 31 and the outer brush 13 in the above-described embodiment. A press button 71 in the shape of a post is fitted with a rubber annular resilient band 72 for automatic resetting of the inner brush 7. A polish body 9 is internally provided with a partition plate 91 so that the polish body 9 has a compartment defined therein for holding a polish oil container 92. A cotton string 93 has one end extending into the polish oil container 92 and the other end passing through a lower rim of a press button 71 into the inner brush 7. Due to capillary action of the cotton string 93, a suitable amount of polish oil may penetrate the inner brush 7 to form an automatic oil supply mechanism. Certainly, in order to prevent drying off of the cotton string 93, it can be fitted with a plastic hose 94.

In summary, the double-brush shoe polishing device of the invention allows the user to control the flow of polish oil and to polish the shoes in a speedy manner without dirtying the hands. Besides, the present invention is ergonomically designed so that it is convenient and comfortable to hold and is also compact and pleasing in appearance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A portable double-brush shoe polishing device, comprising:

a polish body, said polish body being comprised of an upper cover and a lower cover, said upper cover and said lower cover respectively having respective circular tubular guide seats that communicate with each other for accommodating a polish storage device comprising a press button and a polish oil storage tube, said guide seat of said upper cover being provided with a front slide groove and a rear slide groove that face each other at an inner surrounding wall thereof, said front slide groove having a positioning notch at a bottom lateral edge thereof, said press button being provided with a positioning rib and a curved flange respectively at a front side and a rear side thereof for slidable displacement along said front slide groove and said rear slide groove respectively so that when said press button is pressed, said positioning rib may engage said positioning notch to secure an inner brush in position, said lower cover having a circular outer brush disposed at a bottom side thereof, said polish body further having an inner brush that may project from said outer brush upon pressing said press button, said upper cover having a through hole at an upper side thereof so that said press button may have an upper end projecting slightly from said polish body;

said polish storage device, comprising said press button and said oil storage tube, said press button being connected to an upper side of said polish oil storage tube, said polish oil storage tube containing therein a suitable amount of polish oil, said press button having a filler hole at the upper side thereof, said filler hole being covered by a cap of a soft material, said polish oil storage tube being fitted with a reset spring and being disposed in said polish body in a resilient state, said inner brush being connected to a lower side of said polish oil storage tube, with an oil port of a suitable size formed at a place where said inner brush connects said polish oil storage tube, a rod of a diameter slightly smaller than that of said oil port being passed through said oil port, said rod having one end thereof extending into said inner brush and being fitted with a resilient element, with the other end thereof extending into said press button and coupled to a circular valve cover which normally is tightly attached to a bottom plate of said polish oil storage tube to seal said oil port;

a protective cover for covering said outer brush;

wherein said outer brush is used to preliminarily wipe and clean the shoe surface and said press button is pressed to allow oil from said oil port to penetrate into said inner brush and to enable said inner brush to project from said outer brush for polishing the shoe surface;

whereby a user may control the flow of polish oil by controlling the opening and closing of said valve cover with respect to said oil port, so that polish oil may evenly distribute onto the shoe surface.

* * * * *